US007591088B1

(12) United States Patent
Schuh et al.

(10) Patent No.: US 7,591,088 B1
(45) Date of Patent: Sep. 22, 2009

(54) SUCTION DREDGE SYSTEM AND METHOD

(76) Inventors: Allen J. Schuh, 2344 Corte De La Jara, Pleasanton, CA (US) 94566; Peter A. Schuh, 2344 Corte De La Jara, Pleasanton, CA (US) 94566

( * ) Notice: Subject to any disclaimer, the term of this patent is extended or adjusted under 35 U.S.C. 154(b) by 0 days.

(21) Appl. No.: 12/110,860

(22) Filed: Apr. 28, 2008

(51) Int. Cl.
*E02F 3/16* (2006.01)
*B63C 7/22* (2006.01)

(52) U.S. Cl. ..... 37/311; 37/317; 37/321; 37/335

(58) Field of Classification Search ..... 37/317, 37/319, 320, 321, 318, 335, 311, 309
See application file for complete search history.

(56) References Cited

U.S. PATENT DOCUMENTS

| | | | | | |
|---|---|---|---|---|---|
| 1,169,745 | A * | 1/1916 | Haddon | 209/250 |
| 1,416,013 | A * | 5/1922 | Gieseler | 406/152 |
| 1,508,521 | A * | 9/1924 | Kreuser | 37/318 |
| 2,044,088 | A * | 6/1936 | Lord | 417/151 |
| 2,096,595 | A * | 10/1937 | Sanford | 37/311 |
| 2,324,422 | A * | 7/1943 | Patterson | 15/409 |
| 2,603,234 | A * | 7/1952 | Hofer | 137/488 |
| 2,644,400 | A * | 7/1953 | Hofer | 417/282 |
| 2,754,763 | A * | 7/1956 | Hofer | 37/311 |
| 2,826,836 | A * | 3/1958 | Hoffman | 37/311 |
| 3,010,232 | A * | 11/1961 | Skakel et al. | 37/195 |
| 3,301,606 | A * | 1/1967 | Bruno | 406/85 |
| 3,967,341 | A * | 7/1976 | Gavin | 15/345 |
| 4,027,407 | A * | 6/1977 | Kiss | 37/321 |
| 4,178,704 | A * | 12/1979 | Latimer et al. | 37/318 |
| 4,346,937 | A * | 8/1982 | Latimer et al. | 299/8 |
| 4,347,675 | A * | 9/1982 | Latimer | 37/318 |
| 4,400,138 | A * | 8/1983 | Baer | 417/179 |
| 4,412,790 | A * | 11/1983 | Ruyter | 417/306 |
| 4,822,106 | A * | 4/1989 | Wilson et al. | 299/9 |
| 5,593,252 | A * | 1/1997 | Relin et al. | 406/85 |
| 5,651,200 | A * | 7/1997 | Walsh et al. | 37/329 |
| 6,367,119 | B1 * | 4/2002 | Jou | 15/330 |
| 6,482,055 | B1 * | 11/2002 | Freitag | 440/46 |
| 6,860,042 | B2 * | 3/2005 | Hutchinson et al. | 37/322 |
| 6,966,132 | B1 * | 11/2005 | Jacobsen et al. | 37/195 |
| 6,979,152 | B2 * | 12/2005 | Bodie et al. | 406/152 |
| 2004/0010947 | A1 * | 1/2004 | Hutchinson et al. | 37/317 |
| 2007/0130807 | A1 * | 6/2007 | Kohutko | 37/341 |

* cited by examiner

*Primary Examiner*—Thomas A Beach
(74) *Attorney, Agent, or Firm*—David Pressman

(57) ABSTRACT

There is disclosed a suction dredge system and method. The suction dredge system may include a suction dredge head, an exhaust hose connected to the suction dredge head, a high pressure fluid source connected to the suction dredge head for providing a flow of high pressure fluid to the suction dredge head to induce a vacuum in the suction dredge head, and the suction dredge head including an automatic blockage clearing device. The method of suction dredging may include providing a flow of high pressure fluid within a suction dredge head in a first direction for inducing a vacuum at an intake of the suction dredge head, and changing the direction of the flow of the high pressure fluid within the suction dredge head to a second direction for clearing a blockage at the intake of the suction dredge head.

19 Claims, 2 Drawing Sheets

SUCTION DREDGE SYSTEM AND METHOD

BACKGROUND

1. Field

The field is suction dredging apparatus, in particular dredging apparatus that resists clogging.

2. Prior-Art Dredging Apparatus

There is no admission that the background art disclosed in this section legally constitutes prior art.

There have been a variety of different kinds of dredge type equipment proposed for gathering materials. For example, reference may be made to the following U.S. Pat. Nos. 3,664,768; 3,964,123; 4,499,713; 4,884,392; 4,889,391; 5,408,766; 5,425,188; 5,487,229; 5,592,805; 5,621,945; 5,791,073; and 6,112,439.

Water suction dredging may be considered to be a system of mining that may involve the balancing of several features including a power source for driving a water pump that takes in water through a first hose and sends it out under pressure through a second hose. The second hose delivers the water under pressure to a nexus containing a suction head feature which joins the intake and exhaust hoses and an opening used to recover by suction material from a body of water such as a river bottom. The recovered material may be carried out by a third hose and delivered to a sorting station.

Several human operators may be required to monitor aspects of the system and the work environment. In small river mining operations, for example, a single human operator may perform some or all of these activities. In larger operations, one human operator may direct the suction head intake orifice (or nozzle) to the material to be taken into the system. That human operator may regulate the proportional flow of material-to-water to be taken into the system. It may be the operator's responsibility to clear fouls as they occur so as to maintain the steady flow of the dredging activity.

Suction dredge intake heads may be a short rigid tube with one or more handles attached. There may be several holes such as four holes (three external) in the head: a first hole for the pressure intake hose, a second hole for the carrier exhaust hose, a third hole for the intake orifice that receives the dredged material, and a fourth internal hole where the pressure intake hose and materials drawn in at the intake orifice combine to enter the exhaust hose.

Each dredge intake head may have an intake opening or orifice in which water and materials to be dredged enter. A human operator may direct the orifice of the dredge head onto the material to be recovered by the system, and may regulate the flow rate of materials by moving the head opening away from the material to free water occasionally if the collection rate is deemed too rapid. A flow rate of water-to-material of nine to one may, for some applications, be considered appropriate to prevent fouling at the intake head or within the exhaust carrier hose that transports the slurry back to a material collection station. Best practices may employ a second water pump in series to maintain pressure in the system all the way to the screening station.

Suction dredge intake heads may become blocked when the human operator allows a too rapid accumulation of materials, such as algae, kelp, or gravel, in a water environment, to enter the intake orifice, or by the attraction of a single large object such as a rock that blocks the entry orifice. The result of a blockage may be the rapid loss of pressure in the exhaust hose causing the dredging to stop until the blockage is cleared. Hence, there may be a loss of productivity.

A probe may be used to free the blocking materials, such as by poking in from the front. However, there may be the possibility that the tool, or the operator's hand, may be sucked into the dredge when the foul is cleared. Manually clearing fouls thus may be dangerous, under certain conditions, to the human operator, as well as being destructive to expensive equipment.

Many factors may limit dredging efficiency. These factors may include the length of hoses, the occurrence and severity of bends in the hoses, the relative internal roughness of the hoses and fittings, the types and tightness of couplings employed, and the design of the Watergate and sluice box. Modern materials, such as high strength polymer suction hoses, efficient pumps, and light weight engines have greatly enhanced for at least some applications, the efficiency of the small dredging operation.

There is a need in certain applications to balance the dredging system because it may be desirable to balance the power of the engines and pumps against the ability of the operator to handle the equipment safely and efficiently. Also, another factor which may be considered is the capacity of the raft being used to support the volume arriving at the material recovery station. The weight of the engines, pumps, and sluice table, if it accumulates yards of material, may overburden the floats of the raft.

A single, experienced operator, with a dredge, may collect many times more material than could be processed by hand collection methods. For example, a six inch (15.2 cm) dredge, in experienced hands, may process approximately twice as much material as can be accomplished with a 4-inch (10.2 cm) dredge. An 8-inch (20.3 cm) dredge may about double the production over a 6-inch (15.2 cm) dredge. A 10-inch (25.4 cm) dredge can double production over an 8-inch (20.3 cm) dredge.

In the larger dredges, there may be a danger inherent in the larger scope of activity including the requirement for more personnel in the operating area to assist in moving obstacles to the dredge operator's access to targeted material. There may also be a need for vigilance during production so as not to input too much material at the head too quickly that it causes a blockage, or to have an operator's or assistant's body part sucked into the equipment while attempting to clear the blockage. Safety is, of course, important in the operation of such equipment.

Generally, the blockage at the head slows down the production of dredgers. The volume of material that is sucked up the nozzle in any given location may determine production. Volume momentum may be lost every time the operator has to clear a blockage manually, and safety is always a concern.

In the history of the development of suction dredge technology there may be a correlation between the changing source of suction power and the shape of the dredge head nozzle. The dredge usually functions on the same principle, independently of the power source. In this regard, the principle of operation of conventional dredges may relate to the use of a vacuum created by the Venturi effect. A siphon from the movement of water in a pipe, hose, or tube, may create a negative pressure that pulls the water and other materials through the nozzle intake opening, through the exhaust hose, and delivers it to the collection station or sluice.

In ancient times when the source of the suction power may have been from gravity pulling water through a tube, whether rigid as an iron pipe or flexible as a fire hose, a straight suction dredge nozzle may be attached to a short carrier hose inserted anywhere at or below the point where the suction was considered adequate to remove the targeted material. The combination of the intake water and dredged slurry material may be carried through by suction to the exhaust portion of the tube, and may then be deposited in a location below that point on a vertical scale where the sorting of the material took place. Typically, the slurry borne material may mechanically be deposited onto an artificial alluvial plane. When the water entered the plane and spread out, the decrease in pressure resulted in deposit of the material with the greatest specific gravity, such as gold, close to the exit point, while the lighter, less valuable dross debris carried further. Thus, the material closest to where the exit hose made its deposit may have been examined most closely by the miner for valuables.

When the miners may have been using gravity flow as the power for the dredging, the location of the intake of the water at the beginning of the process may have been a distance from the point of deposit of the materials dredged. The distance might be great both on the vertical and horizontal geographic planes. Hence, the side entry tube configuration may have been straight and entered the main current of the flowing water obliquely at a slight angle so as to attempt to maintain the largest possible suction. Calculations may have shown that the degradation of suction that occurred as the angle of intercept moved away from the main flow of the water. The closer the angle approached unity as the cosine of angular separation of their central axis, the greater the force of the suction. Thus an angle of 30 degrees separation may have a higher cosine than 45 degrees, thus the 30 degrees may be better.

On relatively level ground, where gravity flow systems may not have been practical or possible, the steam engine came into its own as the source of pump power and these areas may have then become workable. At least at first no change in nozzle head design may have been required. The steam engine may have been located at one place on a river bank and further down stream could be the location of the alluvial plain for the recovery of dredged materials. The dredge head could still be essentially straight in configuration.

Eventually, internal combustion engines operating on methane, ethanol, gasoline, or diesel took over from steam as the source of power to drive the water pump. Electric pumps could also be used of course. What remained was the idea that the source of water being drawn into the system did not have to be in the same location as the place where the dredged material would be deposited for sorting. When miners built their own dredges, there may not have been the need to change from the original head design as being essentially a straight tube intersecting the suction hose at a shallow angle leading into the exhaust hose.

The shape of the suction head may have changed only as a matter of convenience when a portable power source made the recreational gold dredger the dominant feature in the gold fields. Anywhere a portable dredge may be transported and entered into the water of a stream, miners may have set an engine, water pump, hoses, and a sluice box on a single floatation device which they would anchor somewhere in one location to work the streambed gravels directly below. If the location was changed, the whole flotation may have been moved to the new location. Hence, the source of power to the suction dredge system may have been at, or was almost at, the same location as the sluice box for the material recovered. Now the hoses of the system, both sending pressure hose and receiving exhaust hose, were at almost the same place, floating on the same flotation device, and so the suction dredge head of the operation became modified in numerous variations often only aesthetic.

This modification from being a straight pipe intersecting a straight pipe in a shallow V shape, may have evolved to being curved like a U or perhaps a lower case h, may have been an artifact of the relocation of the hoses both sending and receiving, and was not necessary other than for convenience. The commercial dredge manufacturers accommodated the expectations of their customers and constructed dredge heads in the U or h shape, although there may have been variations in length of the solid tube and it may have had multiple handles, and support mechanisms between the end units where the sending and receiving hoses intersected.

BRIEF DESCRIPTION OF THE DRAWINGS

The features of the various embodiments and the manner of attaining them will become apparent, and the system itself will be best understood by reference to the following description of various aspects of certain embodiments of the system taken in conjunction with the accompanying drawings, wherein.

DETAILED DESCRIPTION OF CERTAIN EMBODIMENTS OF THE INVENTION

Figure 1:
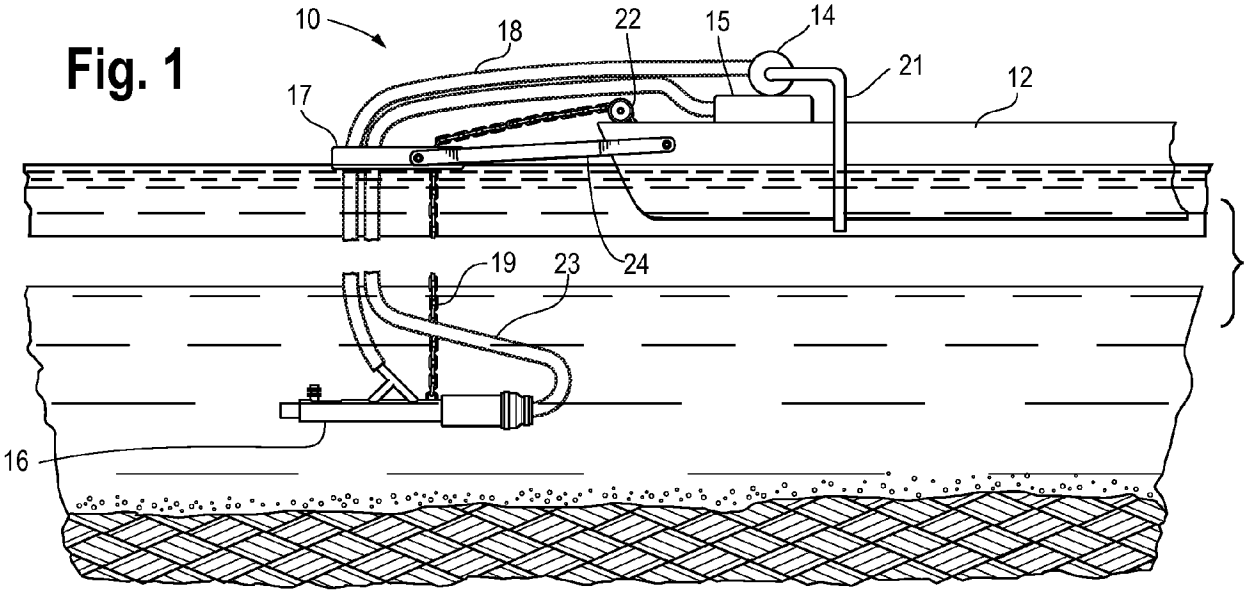
FIG. 1 is a pictorial view of a suction dredge system according to one embodiment.

The components of the embodiments as generally described and illustrated in the drawings can be arranged and designed in a wide variety of different configurations. Thus, the following more detailed description of the embodiments, and methods of the present system, as represented in the drawings, is not intended to limit the scope of the disclosure, as claimed, but is merely representative of various aspects of the embodiments.

There is disclosed a suction dredge system and method. The suction dredge system may include a dredge intake head that features a mechanism for automatically clearing material that blocks the intake orifice. The system may be particularly useful for removing material, such as algae, gold, sediment, gravel, etc., from the bed of a pond, lake, river, stream, or other water system.

In accordance with one aspect of certain embodiments, there is provided a suction dredge system. The suction dredge system may include a suction dredge head, an exhaust hose connected to the suction dredge head, a high pressure fluid source connected to the suction dredge head for providing a flow of high-pressure fluid to the suction dredge head to induce a vacuum in the suction dredge head, and the suction dredge head including an automatic blockage clearing device.

According to a method of a disclosed embodiment of the system, there is provided a method of suction dredging including providing a flow of high-pressure fluid within a suction dredge head in a first direction for inducing a vacuum at an intake of the suction dredge head, and changing the direction of the flow of the high pressure fluid within the suction dredge head to a second direction for clearing a blockage at the intake of the suction dredge head.

To clear blockages at the intake orifice of the suction dredge head in a simple, fast, and safe manner, the present suction dredge system may provide a feature that ejects clogged material by the action of a retraction mechanism that reverses the direction of the flow of pressurized water through the suction dredge head. The pressurized water may then jettison the obstruction from the intake of the suction dredge head before resuming normal dredging operations. Because of this near instantaneous hands-off clearing of blockages from the suction dredge head, the continuity of dredging operations may be minimally impacted by blockages that would otherwise require the intervention of a human operator to stop production and to clear the blockages.

In one aspect, the suction dredge head may include an automatic blockage clearing device that operates by a retracting mechanism that may actuate upon a blockage being detected at the intake orifice. The retraction action may cause a temporary reversal of the flow of the water in the suction dredge head, thus it switches from drawing in material to pushing the blocking material back out through the intake of the suction dredge head. When the blocking material is ejected, the retracted mechanism may return to its original position by a combination of partial difference in Venturi pressure at a nexus of the pressure hose and may be assisted by a spring, causing the dredging operation to return to the normal production operation. The automatic clearing of blockages may be safer for the human operator, less potentially damaging to equipment, and allowing only a temporary loss of production from which the process recoveries immediately and automatically. Therefore, the operator's attention may not be diverted from other important tasks, such as safe operation of the system.

The angle of the intersection of the water coming in from the high pressure hose where it enters the dredge head may be critical in determining the suction pressure at the intake and its ability to move material effectively into and through the exhaust hose. The exhaust hose may carry away all materials collected by suction at the intake of the suction dredge head and deliver them to the materials collection station, often onto a sluice box sorting table positioned below a water gate.

The shape of the high-pressure inlet may resemble a letter Y with a bar resting on its top. An acute angle A between an outlet or normal supply branch 43 and a main tube 25 is illustrated generally in the drawings, with angle A preferably being about 30 degrees. An acute angle B between another outlet or supply branch 45 and the main tube 25 is also illustrated generally in the drawings, with angle B preferably being about 45 degrees.

According to one aspect of the presently preferred embodiment, this configuration during dredging may have the high-pressure water entering the nexus from the long leg of the y shaped feature at an angle A of 30 degrees, and sending that water through a hole in a retractable mechanism, which may fit within a larger sleeve, while the retractable mechanism or inner sleeve is in a forward position. In that position, the covered hole within the unit may be the short intersect at angle B of 45 degrees of the letter y during suction dredging.

The key to the operation may be that only one hole at the top of the y is uncovered at a time. One of the entry points may be of water under pressure entering the system to perform its regular duty of sending water into the exhaust hose at a high velocity creating the required vacuum to suction in material at the intake at the front of the dredge head. When the suction is blocked at the intake of the suction dredge head by material, the internal automatic clearing feature may perform its duty of moving the inner sleeve to its retracted position within the head, simultaneously exposing the flushing feature, while covering the suction feature. In a burst, the blockage may be cleared, suction pressure which retracted the inner sleeve may be relieved, and a spring feature may send the head back to its suction position, and dredging may continue almost immediately, automatically, and safely.

One key to clearing safely and rapidly a blocked intake head may be to change the direction of the flow of the water, from going into the exhaust hose, but rather to going out the entry opening of the head.

In another aspect, the suction dredge head may have five holes in it rather than the typical four. The four previously described holes may still be there and still perform their previous functions. For example, the front opening may be for the intake of ambient materials to be dredged. The new design may incorporate a retractable inner sleeve that extends forward of the head opening while in its normal operating position. The inner sleeve may be held in that position by a spring maintaining forward tension.

The sleeve may automatically clear itself of a blockage when retracted. If blocked, the suction action in the exhaust hose may retract the inner sleeve, which may engage the clearing action feature overcoming the spring tension. That is, the suction may draw the blocked inner sleeve to its retracted position because the vacuum pressure temporarily exceeds the potential energy of the spring.

The hole in the suction dredge head for the intake hose for normal dredging operations may be temporarily shut, simultaneously the hole in suction dredge head for clearing blockages may be opened which directs water pressure forward out the intake orifice. After the clearing action, when the blockage material exits out the intake of the suction dredge head, the vacuum pressure, which held the retractable head back against the compressed spring within the feature, may stop and the kinetic energy of the spring may return the sleeve to its normal forward extended position, which may discontinue the forward water blast, and may re-engage the suction action into the exhaust hose.

FIG. 1 shows a side view of a suction dredge system in accordance with one aspect of the present system. The suction dredge system 10, may be incorporated on a pontoon, barge, raft, or other supporting structure 12 for use on a body of water. System 10 may include a high-pressure pump 14 for providing a fluid at high-pressure to a suction dredge head 16 disposed within the body of water for collecting algae or other desired materials. The high-pressure fluid may be used to create a vacuum within head 16 by means of the Venturi effect to suction up material from the body of water and deliver it to a collection station 15 in a supporting structure 12. Station 15 may be a single collection tank or a plurality of collection tanks.

The suction dredge head 16 may be supported at a desired level within the body of water by a float 17 and a chain 19 or other suitable line. The float 17 may be attached to and extended from the supporting structure using an arm 24. The arm 24 may be movable and extendable to permit the float 17 to be positioned in various locations around the supporting structure 12, and may also permit the float 17 and suction dredge head 16 to be elevated out of the water during transit of the supporting structure 12. The chain 19 may at a first end be attached to the suction dredge head 19, then be routed through the float 17, and be attached to a winch 22 or other receiving device on the supporting structure 12 so that the depth of the suction dredge head 16 in the water may be controlled from the supporting structure 12.

The high-pressure pump 14 located on supporting structure 12 may draw water from the body of water via intake hose 21 and deliver water under high pressure via high-pressure hose 18 to suction dredge head 16. The high pressure water may induce a vacuum in head 16 to suction up material and then carry the material to collection station 15 in supporting structure 12 via an exhaust hose 23. It is contemplated that a high flow rate such as about 33 gallons (125 liters) of material per minute would be achieved by utilizing head 16. Thus, especially at such high flow rates and even at slower rates, it is important to clear blockages in a fast and efficient manner.

Figure 2:
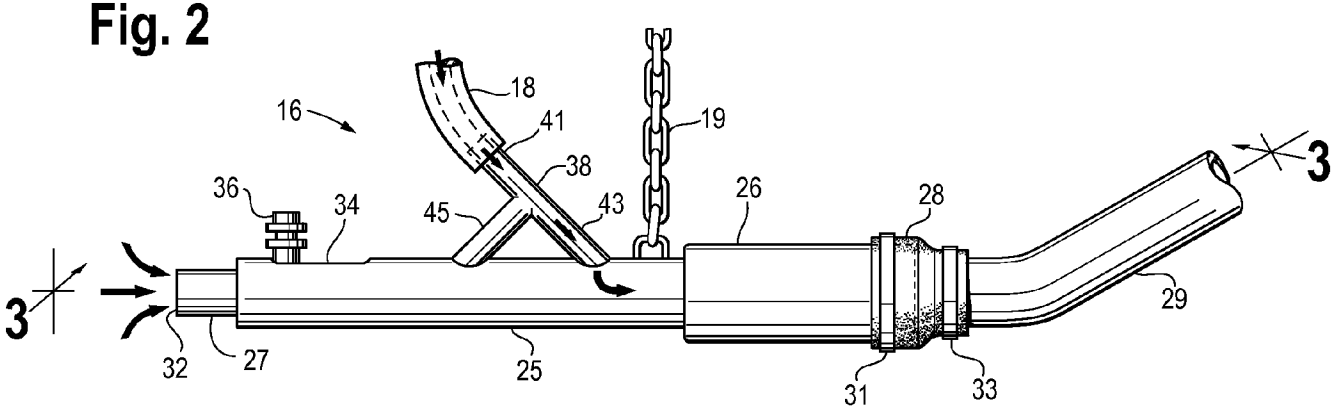
FIG. 2 is a diagrammatic side view of the suction dredge head of FIG. 1.

FIG. 2, shows a side view of the suction dredge head 16 capable of automatically clearing blockages. Head 16 may provide an intake 32 for collecting material and an exhaust outlet 29 having a connection for the exhaust hose. Head 16 may include a pair of telescoping tubes, an outer main tube 25 and in inner tube 27, and a high-pressure fluid inlet 38 attached to outer main tube 25. According to an aspect of one embodiment, the diameter of outer main tube 25 may be about one inch (2.54 cm), and the diameter of the inner tube 27 may be about ¾ inch (1.9 cm). It should be understood that different larger and smaller sizes may also be employed. The outer tube 25 may include a spring containment tube 26. A boot 28 may be attached to spring containment tube 26 and inner tube 27 by a pair of clamps 31, 33 to prevent water and material from entering spring containment tube 26. The movement of inner tube 27 and outer main tube 25 may be limited by a guide pin 36 extending from inner tube 27 through a guide track 34 formed in the outer main tube 25. The suction dredge head 16 may include a single guide pin or more than one guide pin located at different locations around the device.

According to an aspect of one embodiment, high-pressure fluid inlet 38 may be constructed of ½ inch (1.25 cm) diameter tubing and configured in the shape of an upside down Y with the two legs attached to outer main tube 25. The high-pressure fluid inlet 38 may include an intake port 41 for connecting to the high pressure hose 18 to receive the high-pressure fluid, a normal supply branch or outlet 43 for providing the high-pressure fluid to the suction dredge head during normal operation, and a blockage clearance branch or outlet 45 for providing the high-pressure fluid toward intake 32 for clearing obstacles from intake 32. According to the preferred embodiment, the normal path between intake port 41 and normal branch 43 may be straight and intersect outer main tube 25 at approximately a 30-degree angle A to direct the high-pressure fluid toward exhaust outlet 29. With angle A being 30 degrees, the blockage clearance path to blockage clearance branch 45 may intersect the normal path at approximately a 105-degree angle C and outer main tube 25 at angle B of 45 degrees to direct the high-pressure fluid toward intake 32.

Figure 3A:
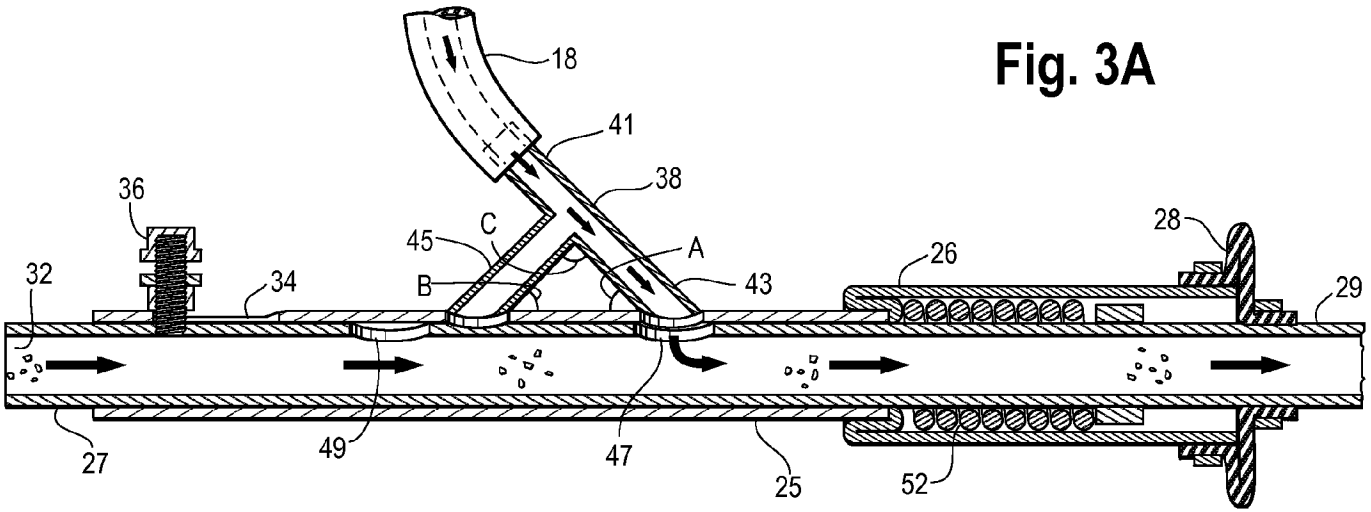
FIG. 3A is a diagrammatic side partial sectional view of the suction dredge head of FIG. 2 in the normal operating mode.

FIG. 3A, shows a partial section view of the suction dredge head 16 in the normal operating mode. In the normal operating mode, inner tube 27 may extend by 1 to 2 inches (2.5 to 5 cm) from outer main tube 25 with the extension of inner tube 27 limited by the guide pin 36 contacting the left end of guide track 34. A spring 52 in its relaxed state may be disposed near exhaust outlet 29 between spring containment tube 26 and inner tube 27 with one end attached to sprint containment tube 26 and the other end attached to inner tube 27. The boot 28 attached to the spring containment tube 26 and inner tube 27 may be in a compact condition. The inner tube 27 may have a normal fluid inlet port 47 and a blockage clearance inlet port 49.

In the normal operating mode with inner tube 27 extended from the outer main tube 25, normal fluid inlet port 47 may be aligned with normal outlet 43 of high-pressure fluid inlet 38 to direct the high-pressure fluid into the suction dredge head 16 toward exhaust outlet 29, while the blockage clearance branch 45 of high-pressure fluid inlet 38 may be closed off by the outside of inner tube 27.

Figure 3B:
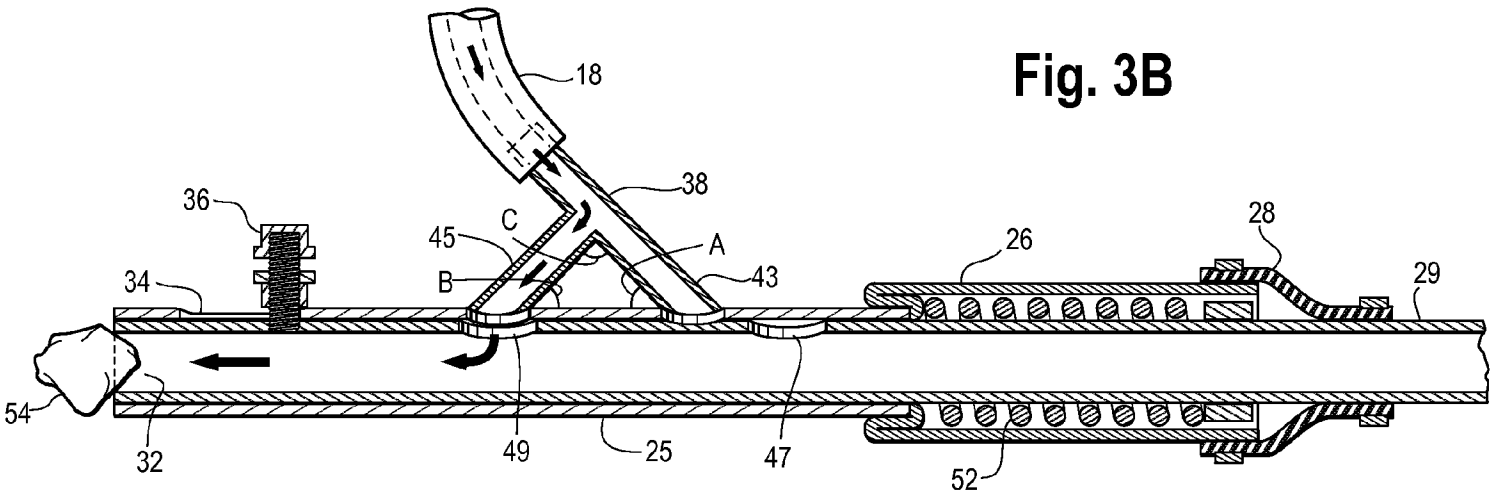
FIG. 3B is a diagrammatic side partial section view of the suction dredge head of FIG. 2 in the blockage clearance mode.

FIG. 3B shows a partial section view of suction dredge head 16 in the blockage clearance mode. A blockage 54 at intake 32 of suction dredge head 16 may cause a substantial portion of the extending section of inner tube 27 to be retracted into outer tube 25 by the vacuum within head 16. The retraction of inner tube 27 may be limited by guide pin 36 contacting the right end of guide track 34. With blockage 54 restricting flow at intake 32, the vacuum in head 16 may cause inner tube 27 to be retracted by overcoming the tension in spring 52 and causing it to stretch. With inner tube 27 retracted, blockage clearance inlet port 49 may be aligned with blockage clearance branch 45 of high-pressure inlet 38 to direct the high-pressure fluid into the suction dredge head toward intake 32 to clear the blockage, while normal branch 43 of high-pressure fluid inlet 38 may be closed off by the outside of inner tube 27.

Once the blockage has been cleared by the direct high pressure fluid, the vacuum within the suction dredge head 16 may be lost allowing the tension in spring 52 to move the inner tube 27 back into its extended and normal operating mode position as shown in FIG. 3A. The inner tube 27 may be manually retracted if the operator of the suction dredge system wants to achieve a controlled blowing action on material the operator wishes to clear from the dredging area. In such a situation, there may be a temporary loss in exhaust hose pressure which temporary loss may not be a significant problem, especially where a multiple number of like or similar dredge heads may be employed simultaneously and where a second pump may be employed.

A method of suction dredging using a suction dredge head attached to an exhaust hose according to one aspect of the present embodiment will now be described. A high-pressure fluid may be provided to the suction dredge head such that the high-pressure fluid may be directed in a first direction toward the exhaust hose. With the high-pressure fluid directed in the first direction, a vacuum may be induced in the suction dredge head drawing material into the suction dredge head. The material may then be transported out the exhaust hose by the high-pressure fluid. When a blockage of the intake of the suction dredge head is detected, the high-pressure fluid may be re-directed in a second direction toward the intake of the suction dredge head. With the high-pressure fluid directed in the second direction, the blockage may be cleared from the intake of the suction dredge head. Once the blockage is cleared from the intake of the suction dredge head, the high-pressure fluid may be re-directed back in the first direction.

The spring, shown in FIGS. 3A and 3B, may be attached during initial assembly or at the time of replacement by disconnecting the exhaust hose, removing the guide pin, removing the inner tube, sliding the spring into the spring containment tube of the outer main tube and connecting the forward lip of the spring to its position in the spring containment tube, then inserting the inner tube into a position so the spring is between it and the spring containment tube. The inner tube may now be pushed far enough into the outer main tube so it extends beyond the opening at the exhaust end of the outer main tube to expose the attachment member for the other spring lip on the inner sleeve, then the inner tube may be pushed back into the outer main tube and the guide pin reattached.

The device is not limited to the use for retrieving algae. The device can also be used to retrieve other objects and substances such as gold from a streambed. But, it will become apparent to those skilled in the art, after becoming aware of the embodiments disclosed, that various aspects of the present system relate to a variety of other applications where blockage clearing may be important. Such other applications may include, but are not limited to, the clearance of blockages in swimming pool pumping systems, aquarium filtration systems, animal grooming, cleaning valuable furniture, and many others.

This present system relates to the broad art of digging, moving, and handling material. This includes methods or devices for the removal of material from an in situ location, either on the earth's surface or within a body of water or other. The principles described hold equally whether the dredge mechanism is operating in air or water.

Whenever the words such as "about", "approximately", "substantial" or similar are used herein, such words shall be defined to mean a tolerance of plus or minus 20 percent.

While various aspects of particular embodiments of the present system have been disclosed, various different modifications are possible and are contemplated within the true spirit and scope of the appended claims. For example and not by way of limitation, various different combinations of angles A, Band C may be employed, and they should not be limited to the preferred examples only. There is no intention, therefore, of limitations to the abstract or disclosure. The scope should be determined by the appended claims and their legal equivalents and not by any specifics given.

What is claimed is:

1. A suction dredge system, comprising:

a suction dredge head having a dredge-material intake, a dredge-material exhaust outlet, and first and second pressurized fluid inlet ports between said dredge material intake and said dredge material exhaust outlet, a pressurized fluid supply line having first and second pressurized fluid supply branches connected to said first and second inlet ports, respectively, said first and second inlet ports being selectively openable, said second inlet port being springably held normally open, said first pressurized fluid supply branch arranged to direct pressurized fluid generally toward said dredge material intake when said first inlet port is open, so that when said first inlet port is open, said fluid flows toward said dredge material intake, thereby creating a pressure at said dredge material intake, and said second pressurized fluid supply branch arranged to direct pressurized fluid generally toward said dredge material exhaust outlet when said second inlet port is open, so that when said second inlet port is open, said fluid flows toward said dredge material exhaust outlet, thereby creating a vacuum at said dredge material intake, whereby when said second pressurized fluid inlet port is open and said first pressurized fluid inlet port is closed and a blockage clogs said dredge material intake, said second pressurized fluid inlet port will be closed and said first pressurized fluid inlet port will be opened, so that said pressure at said intake will tend to dislodge said blockage from said intake.

2. The suction dredge system of claim 1, further including a high-pressure fluid source connected to said pressurized fluid supply line and arranged to supply a pressurized fluid to said pressurized fluid supply line and said first and second pressurized fluid supply branches.

3. The suction dredge system of claim 1 wherein said suction dredge head includes an inner tube and an exterior tube and said first and second pressurized fluid inlet ports are joined to said first and second pressurized fluid supply branches.

4. The suction dredge system of claim 2 wherein said inner tube includes a pair of inlet ports for said high-pressure fluid, said second inlet port being arranged to cause said high-pressure fluid to induce a vacuum at said intake of said suction dredge head, and said first inlet port is arranged to cause said high-pressure fluid to clear said blockage at said intake of said suction dredge head.

5. The suction dredge system of claim 2, further including a guide track formed in said exterior tube and a guide pin extending from said inner tube through said guide track.

6. The suction dredge system of claim 2, further including a spring having a first end affixed to said inner tube and a second end affixed to said outer tube so that when said blockage is absent, said spring urges said second outlet into alignment with said second inlet port.

7. The suction dredge system of claim 1, further including an exhaust hose connected to said exhaust outlet and a collection station in communication with said exhaust hose.

8. The suction dredge system of claim 7 wherein said collection station includes one or more collection tanks.

9. The suction dredge system of claim 1 wherein said high-pressure fluid source is disposed on a mobile support structure.

10. The suction dredge system of claim 9 wherein said mobile support structure is resistant to corrosion when placed in a body of water.

11. The suction dredge system of claim 10, further including a float attached to said suction dredge head to control the depth of said suction dredge head within said body of water.

12. The suction dredge system of claim 11, further including an arm connecting said float to said support structure.

13. The suction dredge system of claim 11, further including a depth-adjusting device disposed on said mobile support structure for adjusting the depth of said suction dredge head in said body of water.

14. A method of suction dredging, comprising:

providing a suction dredge head having a dredge-material intake, a dredge-material exhaust outlet, and first and second pressurized fluid inlet ports between said dredge material intake and said dredge material exhaust outlet, providing a pressurized fluid supply line having first and second pressurized fluid supply branches connected to said first and second inlet ports, respectively, said second inlet port being springably held normally open and said first inlet port being springably held normally closed, providing a source of high-pressure fluid for supplying high-pressure fluid to said pressurized fluid supply line, said first pressurized fluid supply branch capable of directing said high-pressure fluid generally toward said intake when said first inlet port is open, so that when said first inlet port is open, said high-pressure fluid flows toward said intake, thereby creating a pressure at said intake, and said second pressurized fluid supply branch capable of directing said high-pressure fluid generally toward said exhaust outlet when said second inlet port is open, so that when said second inlet port is open, said high-pressure fluid flows toward said exhaust outlet, thereby creating a vacuum at said intake, causing said high-pressure fluid to flow through said pressurized fluid supply line, whereby when said second inlet port is open and said first inlet port is closed and a blockage clogs said intake, said second inlet port will be closed and said first inlet port will be opened, thereby using said pressure to dislodge said blockage from said intake, and after said blockage is dislodged, said first inlet port will be springably closed and said second inlet port will be reopened, whereby when said intake of said suction dredge head is clogged by said blockage, said blockage will be automatically dislodged.

15. The method of suction dredging of claim 14 wherein said suction dredge head comprises a pair of slidably telescoping inner and outer tubes, said first and said second pressurized fluid supply branches are affixed to said outer suction tube, said first and said second inlet ports are formed in said inner tube, and when said first pressurized fluid supply branch is adjacent said first inlet port, said first pressurized fluid supply branch directs said high-pressure fluid through said first inlet port, and when said second pressurized fluid supply branch is adjacent said second inlet port, said second pressurized fluid supply branch directs said high-pressure fluid through said second inlet port.

16. The method of suction dredging of claim 14, further including a spring for urging said inner and said outer tubes to assume a relative position so that said high-pressure fluid flows from said second pressurized fluid supply branch through said second inlet port when said blockage is not present.

17. The method of suction dredging of claim 14 wherein when said blockage is present, said inner and said outer tubes assume a relative position such that said high-pressure fluid flows from said first pressurized fluid supply branch through said first inlet port.

18. The method of suction dredging of claim 14, further comprising springably redirecting said high-pressure fluid through said second inlet port after said blockage is dislodged.

19. The method of suction dredging of claim 14, further comprising positioning said suction dredge head in a body of water and adjusting the depth of said suction dredge head in said body of water using a float.

* * * * *